US009247361B2

(12) United States Patent
Nishizaki et al.

(10) Patent No.: US 9,247,361 B2
(45) Date of Patent: Jan. 26, 2016

(54) HEARING AID, HEARING AID FITTING MANAGEMENT SYSTEM, SERVER DEVICE, AND COMPUTER DEVICE

(71) Applicant: Panasonic Corporation, Osaka (JP)

(72) Inventors: Makoto Nishizaki, Tokyo (JP); Eiji Noguchi, Osaka (JP); Yoshiaki Takagi, Kanagawa (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 262 days.

(21) Appl. No.: 13/747,910

(22) Filed: Jan. 23, 2013

(65) Prior Publication Data

US 2013/0202138 A1 Aug. 8, 2013

(30) Foreign Application Priority Data

Feb. 8, 2012 (JP) ..... 2012-024713

(51) Int. Cl.
*H04R 25/00* (2006.01)

(52) U.S. Cl.
CPC ..... *H04R 25/70* (2013.01)

(58) Field of Classification Search
CPC ..... H04R 25/70; H04R 2225/55
USPC ..... 381/23.1, 60, 312–331; 700/94; 705/2, 705/3
See application file for complete search history.

(56) References Cited

U.S. PATENT DOCUMENTS

| | | | | |
|---|---|---|---|---|
| 7,627,127 | B2 | 12/2009 | Aida et al. | |
| 8,965,542 | B2 | 2/2015 | Frater et al. | |
| 2006/0259330 | A1* | 11/2006 | Schranz | 705/3 |
| 2009/0185703 | A1 | 7/2009 | Aida et al. | |
| 2009/0307590 | A1 | 12/2009 | Frater et al. | |
| 2011/0235835 | A1* | 9/2011 | Bulow et al. | 381/314 |

FOREIGN PATENT DOCUMENTS

| | | |
|---|---|---|
| JP | 11-69496 | 3/1999 |
| JP | 2000-125396 | 4/2000 |
| JP | 2001-128295 | 5/2001 |
| JP | 2001-204098 | 7/2001 |
| JP | 2004-265356 | 9/2004 |
| JP | 2008-546327 | 12/2008 |
| WO | 2009/093301 | 7/2009 |

* cited by examiner

*Primary Examiner* — Joseph Saunders, Jr.
(74) *Attorney, Agent, or Firm* — Wenderoth, Lind & Ponack, L.L.P.

(57) ABSTRACT

A hearing aid fitting management system comprises a fitting device, a server, and a client device that are connectable to each other in a network. The server stores hearing ability data received from the client device as a hearing ability certificate, produces a prescription number corresponding to the hearing ability certificate, and sends the prescription number to the client device. The fitting device sends the server the prescription number that has been inputted. The server sends the fitting device the hearing ability certificate corresponding to the prescription number received from the fitting device. The fitting device sends the hearing ability certificate to a hearing aid, and limits the settings in the fitting of the hearing aid to within the range of the hearing ability data.

14 Claims, 7 Drawing Sheets

HEARING AID, HEARING AID FITTING MANAGEMENT SYSTEM, SERVER DEVICE, AND COMPUTER DEVICE

CROSS-REFERENCE TO RELATED APPLICATIONS

This application claims priority under 35 U.S.C. §119 to Japanese Patent Application No. 2012-024713 filed on Feb. 8, 2012. The entire disclosure of Japanese Patent Application No. 2012-024713 is hereby incorporated herein by reference.

BACKGROUND

1. Technical Field

The technology disclosed herein relates to prevention of the improper fitting of a hearing aid.

2. Description of the Related Art

When a hearing aid is fitted, first the hearing ability of the patient is measured, and then fitting data calculated on the basis of this hearing ability is inputted to the hearing aid. After this, the hearing aid is put on by the patient, and fine tuned. This fine tuning involves having the patient wearing the hearing aid listen to test sounds or voices, and fine tuning the fitting data so as to eliminate any hearing problems the patient may have. This fine tuning work requires experience and knowledge about fitting, and can be very difficult for an adjuster with little experience in fitting work.

In view of this, a remote fitting system has been known in which fitting is performed by an otorhinolaryngology specialist, and the results thereof are consolidated and managed at a fitting center, which improves after-care (see, for example, Japanese Laid-Open Patent Application 2000-125396).

With the above-mentioned remote fitting system, proper adjustment is performed by having the otorhinolaryngology specialist perform the fitting and any subsequent fine tuning.

However, in actual practice, it is extremely difficult for an otorhinolaryngology specialist to perform fitting and subsequent fine tuning for all patients. This is because the number of hearing aid patients far outstrips the number of otorhinolaryngology specialists. Also, when fitting and subsequent fine tuning are performed by an otorhinolaryngology specialist, he must understand the functions of all the new hearing aids that are constantly being developed.

Therefore, this fitting and subsequent fine tuning are actually most often carried out at the place where the hearing aid is sold. In this case, fitting and subsequent fine tuning are sometimes performed by salespeople who are far from having the required knowledge and experience in fitting. Consequently, even though an otorhinolaryngology specialist may have gone to the trouble of setting the fitting data, discomfort level, and so forth, a salesperson or other such person who does not fully comprehend the significance of these will sometimes end up making settings that exceed the discomfort level, for example, so that the hearing aid cannot be adjusted to within the proper range.

Also, a hearing aid cannot be used until it has been fitted by an otorhinolaryngology specialist.

SUMMARY

In view of this, it is an object of the technology disclosed herein to allow patients to begin using their hearing aids more easily.

The hearing aid fitting management system disclosed herein comprises a first client device that makes settings in fitting of a hearing aid, a server device connectable to the first client device so as to be capable of sending and receiving data to and from the first client device, and a second client device connectable to the server device so as to be capable of sending and receiving data to and from the server device. The second client device sends the server device hearing ability data about a user of the hearing aid. The server device stores the hearing ability data received from the second client device as a hearing ability certificate, produces prescription number data corresponding to the hearing ability certificate, and sends the prescription number data to the second client device. The first client device sends the server device the prescription number data that has been inputted. The server device sends the first client device the hearing ability data serving as the hearing ability certificate corresponding to the prescription number data received from the first client device. The first client device sends the hearing ability certificate to the hearing aid. The first client device limits the settings in fitting of the hearing aid to within a range of the hearing ability data.

With the technology disclosed herein, a patient can begin to use a hearing aid more easily.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents.

1. Embodiment 1

1-1. Management System

Figure 1:
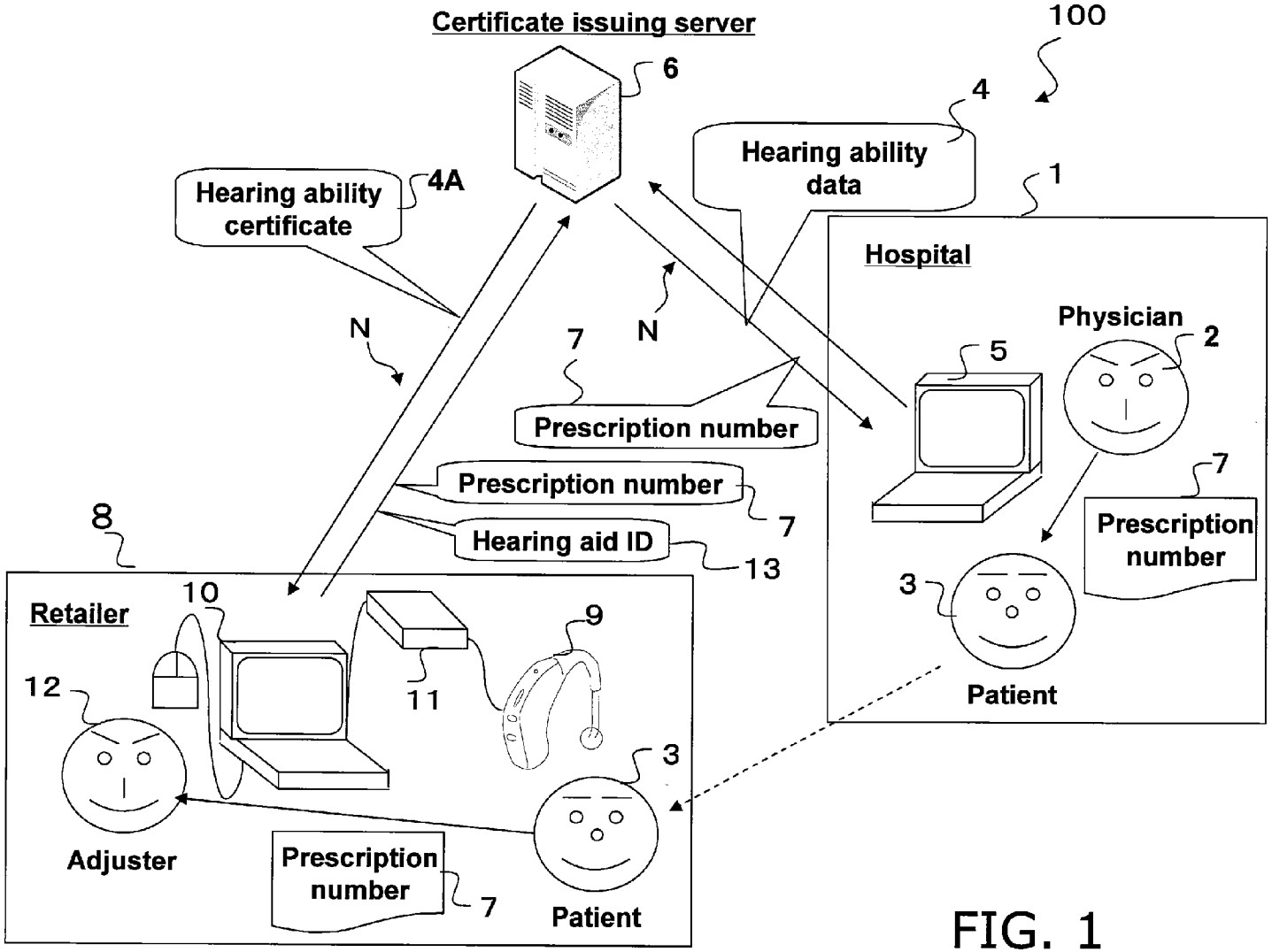
FIG. 1 is a simplified diagram of the configuration of the hearing aid fitting management system pertaining to an embodiment.

First, we will give a rough outline of the flow of a hearing aid fitting management system 100 according to the present embodiment through reference to FIG. 1.

The management system 100 (an example of a hearing aid fitting management system) comprises a fitting device 10 (an example of a first client device), a client device 5 (an example of a second client device), and a server 6 (an example of a server device).

A patient with hearing impairment, who will be the user of the hearing aid, first goes to an otorhinolaryngologist and is diagnosed. In a hospital 1, a physician 2 diagnoses a visiting patient 3 and measures the hearing ability of the patient 3. The physician 2 uses the client device 5 installed in the hospital 1 to input hearing ability data 4 obtained as the result of hearing ability measurement. The inputted hearing ability data 4 is sent through a network N or other such communication line and stored on the server 6 installed at a remote location. At this point the server 6 issues a prescription number 7 for the received hearing ability data 4, and sends this data to the client device 5. This prescription number 7 is displayed on the screen (display component 15 in FIG. 3) of the client device 5, and thus conveyed to the patient 3. Rather than being displayed on a screen, the prescription number 7 may instead be printed on paper by a printer (not shown) and given to the patient 3.

The hearing ability data 4 is data that indicates the hearing ability of the patient 3, obtained from the result of measuring the hearing ability of the patient 3, for example. The hearing ability data 4 includes, for example, a UCL (uncomfortable loudness level) as a discomfort level, an MCL (most comfortable loudness level) as a comfort level, and an HTL (hearing threshold level) as a minimum audible level.

Figure 2:
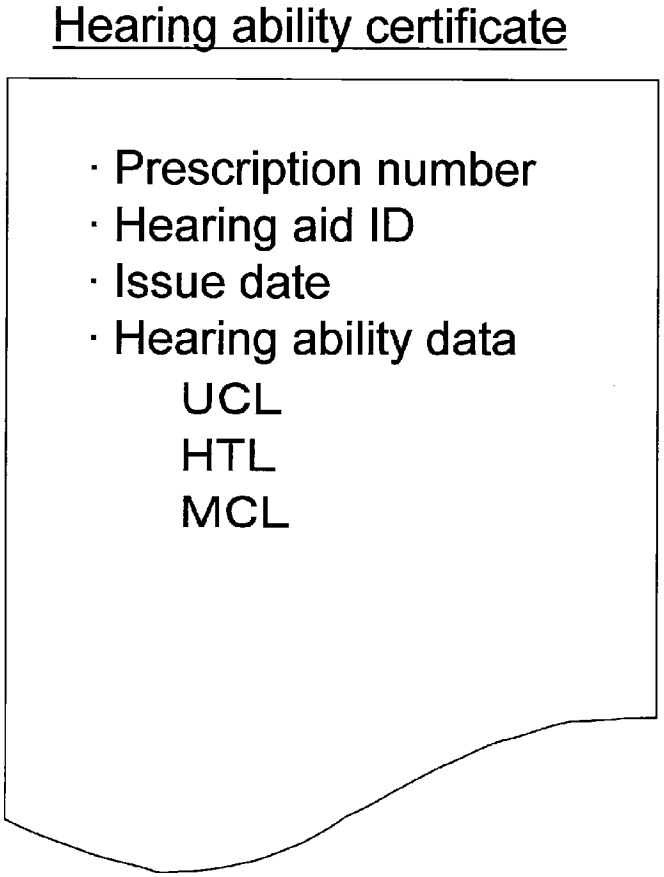
FIG. 2 is a diagram of the format of a hearing ability certificate.

As shown in FIG. 2, the server 6 manages the "hearing aid ID," "prescription number," "issue date," hearing ability data 4 ("UCL," "HTL," and "MCL"), and other such information in a database. All this information will hereinafter be collectively referred to as a hearing ability certificate 4A. At the stage when the above-mentioned physician 2 has sent the hearing ability data 4 for the patient 3 to the server 6, the server 6 stores the hearing ability data 4 as "UCL," "HTL," and "MCL," the prescription number 7 issued by the server 6 itself as "prescription number," and the date on which the hearing ability data 4 was received as the issue date, in the database.

After being diagnosed by the physician 2, the patient 3 purchases a hearing aid 9 at a hearing aid retailer 8. Fitting work is performed at the hearing aid retailer 8 so that the purchased hearing aid 9 will match the hearing ability of the patient 3.

A fitting device 10 and a connection box 11 that connects the fitting device 10 and the hearing aid 9 are installed at the hearing aid retailer 8. The fitting device 10 uses the network N or another such communication line to connect to the server 6 (installed at a remote location) via a specific connection interface.

After the patient 3 has selected and purchased his preferred hearing aid 9 at the hearing aid retailer 8, an adjuster 12 begins the fitting work of matching that hearing aid 9 to the hearing ability of the patient 3. First, the adjuster 12 connects the hearing aid 9 to the connection box 11. After this, the patient 3 inputs a hearing aid ID 13 and the prescription number 7 provided by the physician 2 to the fitting device 10, and these are sent to the server 6. The hearing aid ID 13 is a number that uniquely identifies a hearing aid, such as a serial number. The hearing aid ID 13 may be stored ahead of time as data in the main body of the hearing aid 9, and read out automatically from the hearing aid 9 by the fitting device 10. Or, a serial number stamped into the main body of the hearing aid 9 may be inputted from a keyboard, mouse, or other such input device connected to the fitting device 10.

Upon receiving the prescription number 7 and the hearing aid ID 13, the server 6 looks for the "prescription number" stored in the database, and looks for data that matches the received prescription number 7. If the search is successful, the hearing aid ID 13 is stored as "hearing aid ID" in the database, after which the "UCL," "HTL," and "MCL," and other such hearing ability data 4 from the database corresponding to the prescription number 7 are sent to the fitting device 10.

When the fitting device 10 receives the hearing ability data 4 from the server 6, this data is sent through the connection box 11 to the hearing aid 9. The transmitted hearing ability data 4 is stored in the hearing aid 9.

After this flow of processing, the details of the fitting work are begun by the adjuster 12.

1-2. Client Device and Server

The configuration of the client device 5 and the server 6 will now be described through reference to FIG. 3, and how these operate will be described along the flow of work on the hospital side through reference to FIG. 4.

1-2-1. Configuration of Client Device and Server

Figure 3:
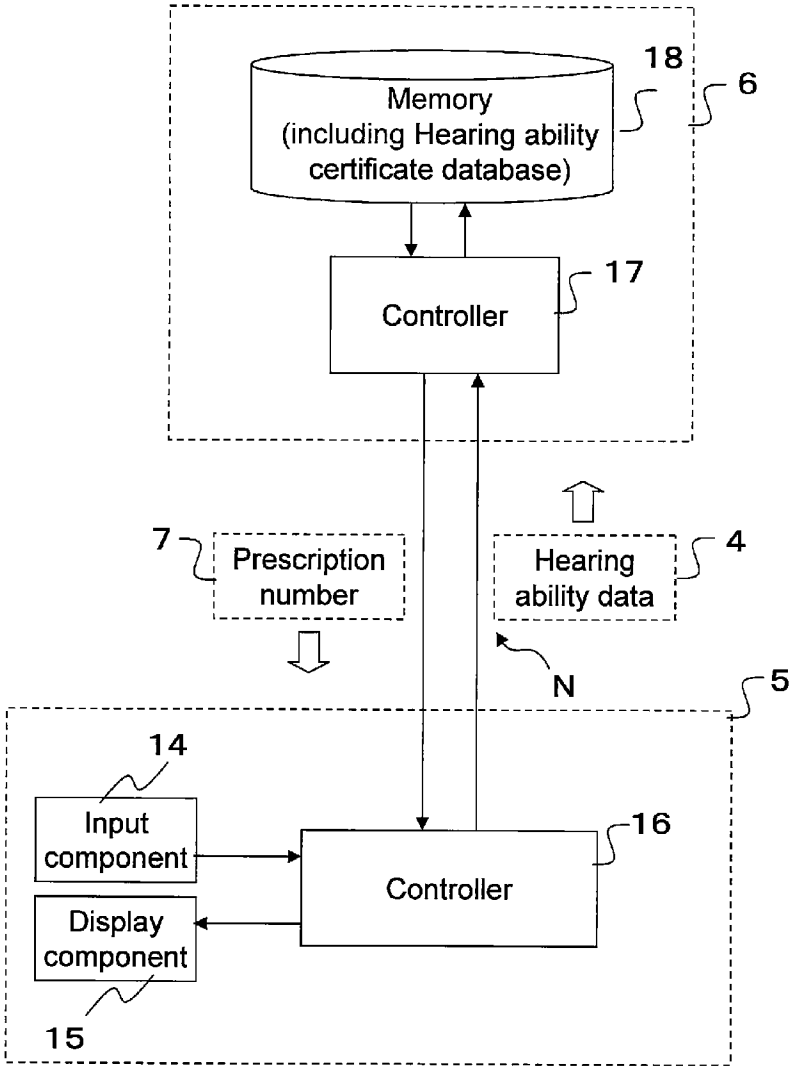
FIG. 3 is a block diagram schematically illustrating the configuration of a client device and a server.
Figure 4:
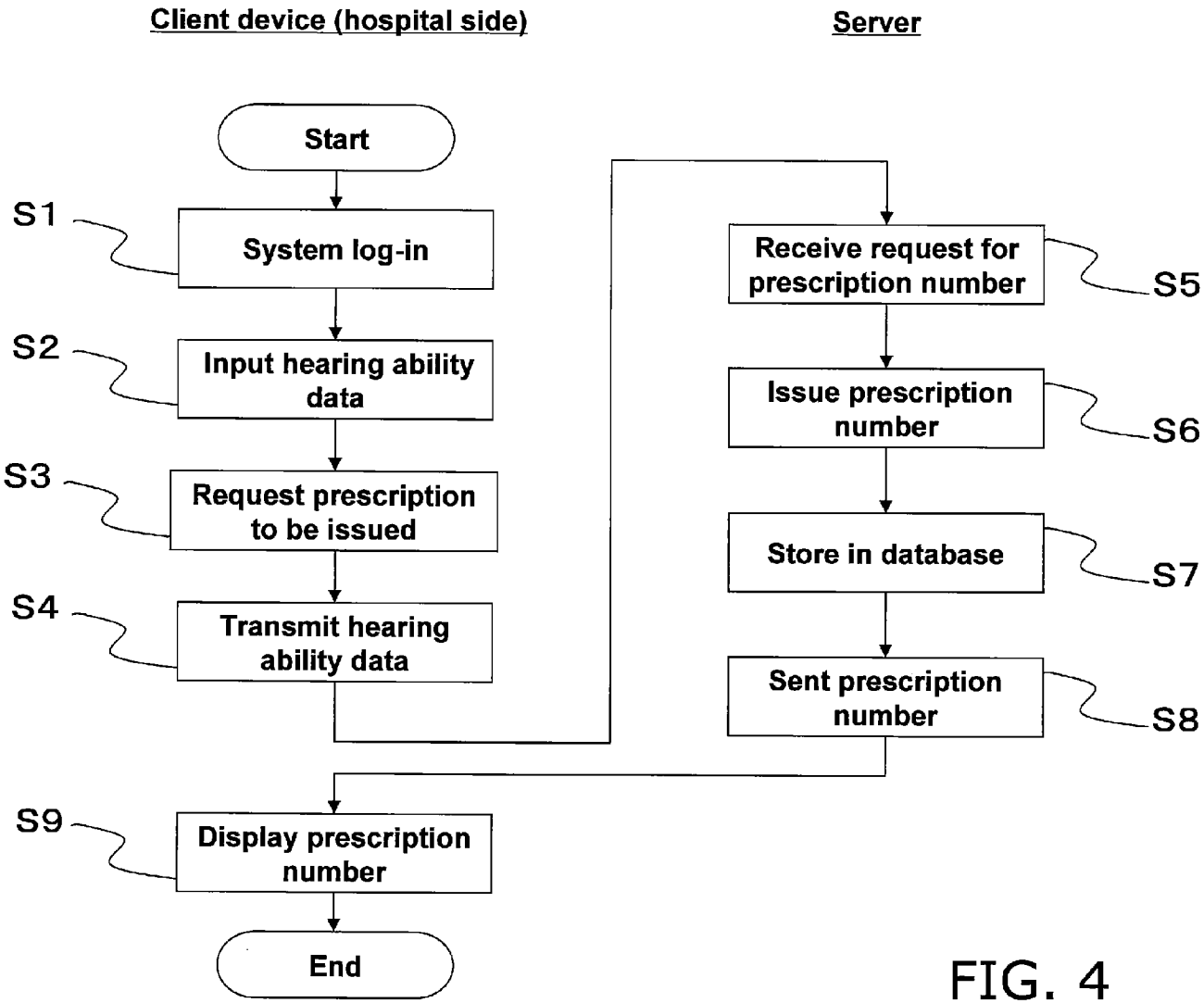
FIG. 4 is a flowchart of the operation between the client device and the server.

FIG. 3 is a block diagram of the client device 5 installed in the hospital 1, and the server 6 connected via the network N to the client device 5.

The client device 5 is an ordinary computer device comprising, for example, a keyboard, mouse, or other such input component 14, a monitor or other such display component 15 that displays data expressing the results of the various information processing that is executed, a controller 16 and so on. The controller 16 is made up of a processor (CPU, etc.) for executing specific programs and a memory for storing these programs or for temporarily storing data processed by the programs, etc. The controller 16 sends and receives data via a given interface.

The server 6 comprises, for example, a controller 17 that is made up of a processor (CPU, etc.) for executing specific programs, a memory for temporarily storing these programs or data processed by the programs, etc., and a memory device 18 such as a hard disk that is connected to the controller 17 and stores various kinds of data.

The client device 5 and the server 6 are connected by the network N so that they can exchange information.

Next, the process performed when the patient 3 is diagnosed at the hospital 1 will be described through reference to FIGS. 1 and 4.

1-2-2. Operation Between Client Device and Server

The patient 3 goes to the hospital 1 and is diagnosed by the physician 2. For this diagnosis, the physician asks questions about the patient's symptoms, actually measures the hearing ability of the patient 3, and so forth. Although not shown in the drawings, a special measurement device is used to measure the hearing ability. This measurement device measures the UCL (discomfort level) over which the patient 3 experiences uncomfortable loudness, the HTL (minimum audible level) below which the patient cannot hear sound, and the MCL (comfortable level) which expresses the proper volume level.

The physician 2 logs in to the system of the client device 5 (S1), after which he inputs the previously measured UCL, HTL, MCL, and other such hearing ability data 4 through the input component 14 (S2). The controller 16 sends the server 6 a request through the network N to issue a prescription (S3), and sends the previously inputted hearing ability data 4 to the server 6 (S4).

As to the operation of the server 6, when the server 6 receives the prescription issuance request from the client device 5 (S5), the controller 17 produces a new prescription number 7 (S6). The received hearing ability data 4 is stored in a hearing ability certificate database in a memory device 18 (S7). The controller 17 sends the issued prescription number 7 to the client device 5 (S8).

The client device 5 displays the received prescription number 7 on the display component 15 (S9). After receiving this prescription number 7 from the physician 2, the patient 3 goes to the hearing aid retailer 8, where he selects a hearing aid and has it fitted.

The fitting of the hearing aid entails adjusting the hearing aid according to the patient's personal preferences for sound and his hearing characteristics, in addition to the hearing ability data. In this fitting work, the adjustment extent (adjustment value) for hearing aid processing by the hearing aid (volume adjustment, frequency characteristic adjustment, output limitation adjustment, automatic gain control adjustment, etc.) is set to the values that are optimal for each individual patient. These settings are stored as fitting data (discussed below).

1-3. Fitting Device and Hearing Aid

The configuration of the fitting device 10 and the hearing aid 9 will be described through reference to FIG. 5, and the flow of work entailed by the operation of these on the retailer side will be described in detail through reference to FIG. 6.

1-3-1. Configuration of Fitting Device and Hearing Aid

Figure 5:
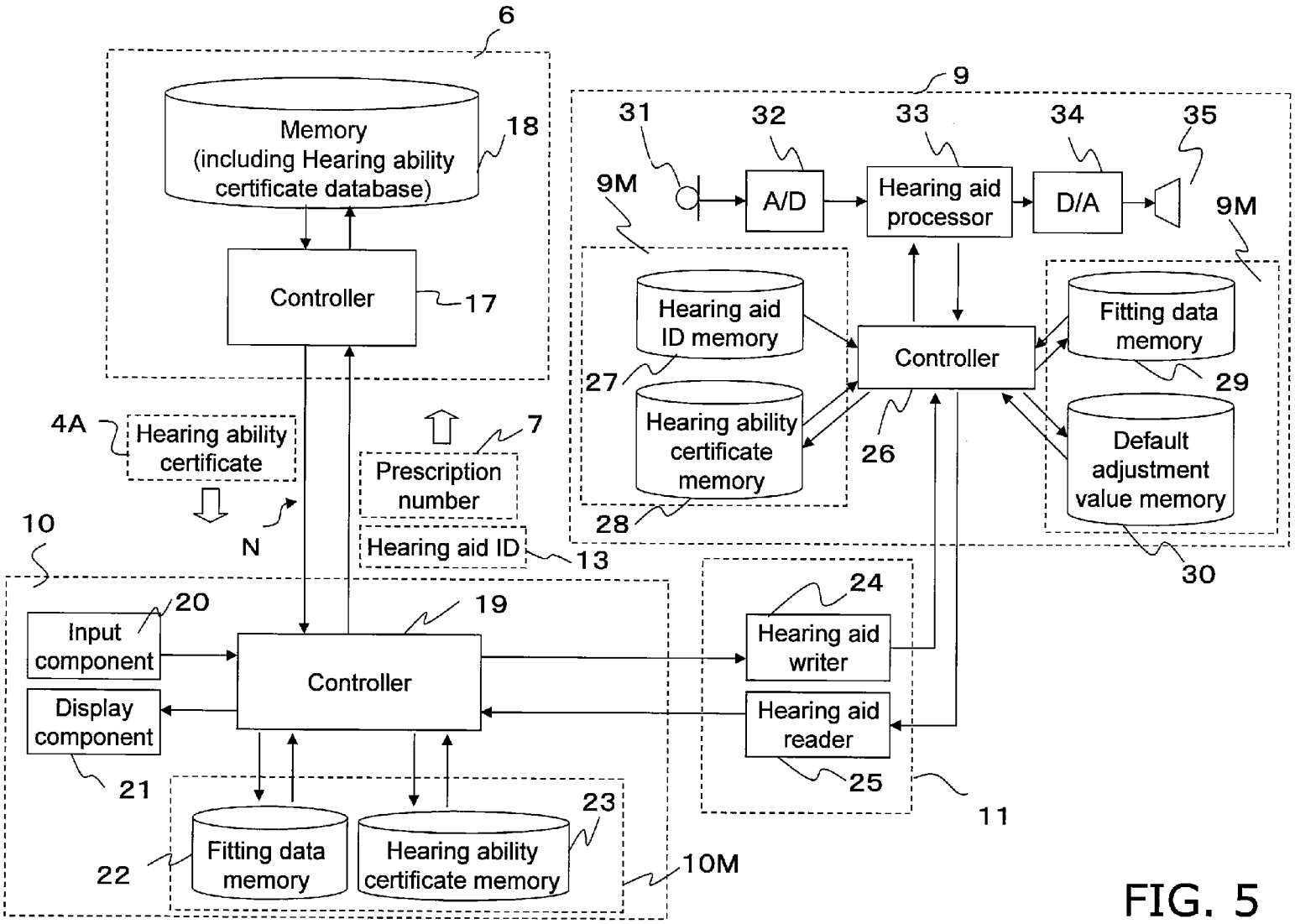
FIG. 5 is a block diagram schematically illustrating the configuration of the server, a fitting device, and a hearing aid.

FIG. 5 is a block diagram of the fitting device 10 set up in the hearing aid retailer 8, the connection box 11 connected to the fitting device 10, and the hearing aid 9 connected to this connection box 11.

The fitting device 10 is an ordinary computer device comprising, for example, a keyboard, mouse, or other such input component 20, a monitor or other such display component 21 that displays data expressing the results of the various information processing that is executed, a controller 19, a memory device 10M such as a hard disk that is connected to the controller 19 and stores various kinds of data, and so on. The controller 19 is made up of a processor (CPU, etc.) for executing specific programs and a memory for storing these programs or for temporarily storing data processed by the programs, etc. The controller 19 sends and receives data through a specific interface. The controller 19 in particular performs various information processing related to the fitting of the hearing aid 9. Furthermore, the memory device 10M has a fitting data memory 22 that stores fitting data, and a hearing ability certificate memory 23 that stores the hearing ability certificate 4A.

The fitting device 10 and the server 6 are connected by the network N and communicate various types of information.

Also, the fitting device 10 is connected to the hearing aid 9 via the connection box 11. The connection box 11 includes a hearing aid writer 24 for writing fitting data and various other such information to the hearing aid 9, and a hearing aid reader 25 for reading fitting data and various other such information from the hearing aid 9.

The hearing aid 9 comprises a controller 26, a memory component 9M, a microphone 31, an A/D converter 32, a hearing aid processor 33, a D/A converter 34, and a receiver 35.

The controller 26 and the hearing aid processor 33 are made up of, for example, a processor (CPU, etc.) for executing specific programs, a memory for storing these programs or for temporarily storing data processed by the programs, etc., and sends and receives data via a specific interface. The controller 26 performs control and communicates various types of information with the fitting device 10 via the connection box 11.

The memory component 9M is connected to the controller 26 and stores data processed by the controller 26. In particular, the memory component 9M has a hearing aid ID memory 27 that stores the hearing aid ID 13, a hearing ability certificate memory 28 (an example of a first memory) that stores the hearing ability certificate 4A, a fitting data memory 29 (an example of a second memory) that stores fitting data, and a default adjustment value memory 30 (an example of a third memory) that stores a default adjustment value.

The microphone 31 collects ambient sound. The A/D converter 32 converts analog audio signals inputted from the microphone 31 into digital audio signals. The hearing aid processor 33 subjects the digital audio signals outputted from the A/D converter 32 to hearing aid processing (volume adjustment, frequency characteristic adjustment, output limitation adjustment, automatic gain control adjustment, etc.) according to the adjustment values that have been set. The D/A converter 34 converts the digital audio signals that have undergone hearing aid processing by the hearing aid processor 33 into analog audio signals. The receiver 35 converts the analog audio signals outputted from the D/A converter 34 into air vibrations, i.e., sound. The hearing aid processor 33 is connected to the controller 26. When hearing aid processing is performed by the hearing aid processor 33, the controller 26 reads data from either the fitting data memory 29 or the default adjustment value memory 30.

1-3-2. Operation Between Fitting Device and Server

Next, the flow of operation by the fitting device 10 and the hearing aid 9 when the patient 3 has the hearing aid fitted at the hearing aid retailer 8 will be described through reference to FIGS. 1, 5, and 6.

After the patient 3 selects the hearing aid 9 at the hearing aid retailer 8, fitting of the hearing aid 9 is started.

The adjuster 12 logs in to the system of the fitting device 10 (S10), after which he connects the hearing aid 9 to the connection box 11 (S11). As a result, the hearing aid ID 13 is read from the hearing aid ID memory 27 of the hearing aid 9, through the hearing aid reader 25 of the connection box 11, and input to the fitting device 10. After this, the prescription number 7 issued to the patient 3 is inputted from the input component 20 of the fitting device 10 (S13), whereupon the controller 19 of the fitting device 10 requests the server 6 to issue a certificate (S14), and sends the server 6 the prescription number 7 and the hearing aid ID 13 (S15).

The server 6 accepts the above-mentioned certificate issuance request, the prescription number 7, the hearing aid ID 13 (S16). The controller 17 of the server 6 determines whether or not a hearing aid ID has been associated with the received prescription number 7 (S17). If another hearing aid ID has already been recorded, then the server 6 does not send the hearing ability certificate 4 and the processing is ended. This means that the hearing ability certificate 4A has already been used by another patient, and it is a safety measure that prevents someone else's hearing ability data from being used accidentally. At this point, an error message such as "prescription number cannot be used" may be displayed on the display component 21 of the fitting device 10.

Meanwhile, if another hearing aid ID has not been stored in association with the prescription number 7, the controller 17 of the server 6 produces the hearing ability certificate 4A (S18). More specifically, the hearing aid ID 13 is recorded (see FIG. 2) in association with the hearing ability data 4 and the prescription number 7 that are managed in the certificate database of the memory device 18 of the server 6.

After this, the server 6 sends the hearing ability certificate 4A associated with the prescription number 7 to the fitting device 10 (S19).

The fitting device 10 receives the hearing ability certificate 4A from the server 6 (S20), and the controller 19 first stores the hearing ability certificate 4A in the hearing ability certificate memory 23 of the fitting device 10. After this, the controller 19 reads the stored hearing ability certificate 4A and sends it to the hearing aid 9 through the hearing aid writer 24 of the connection box 11. The controller 26 of the hearing aid 9 writes the received hearing ability certificate 4A to the hearing ability certificate memory 28 (S21).

After this, the adjuster 12 carries out fitting work so that the hearing aid 9 is matched to the patient 3 (S22).

This fitting work is carried out on the basis of the UCL of the hearing ability certificate 4A stored in the hearing ability certificate memory 23 of the fitting device 10, for example, so that fitting cannot be performed that would exceed this UCL. Consequently, even if the adjuster 12 is insufficiently skilled at fitting, safe fitting can be performed so as to match the hearing ability level measured by the physician 2 having specialized skills.

The controller 19 of the fitting device 10 stores the fitting data (fitting adjustment values) obtained as the result of this fitting in the fitting data memory 22, and sends it to the hearing aid 9. The controller 26 of the hearing aid 9 then writes the fitting data received via the hearing aid writer 24 of the connection box 11 to the fitting data memory 29 (S23). This concludes the overall flow of the fitting.

Figure 6:
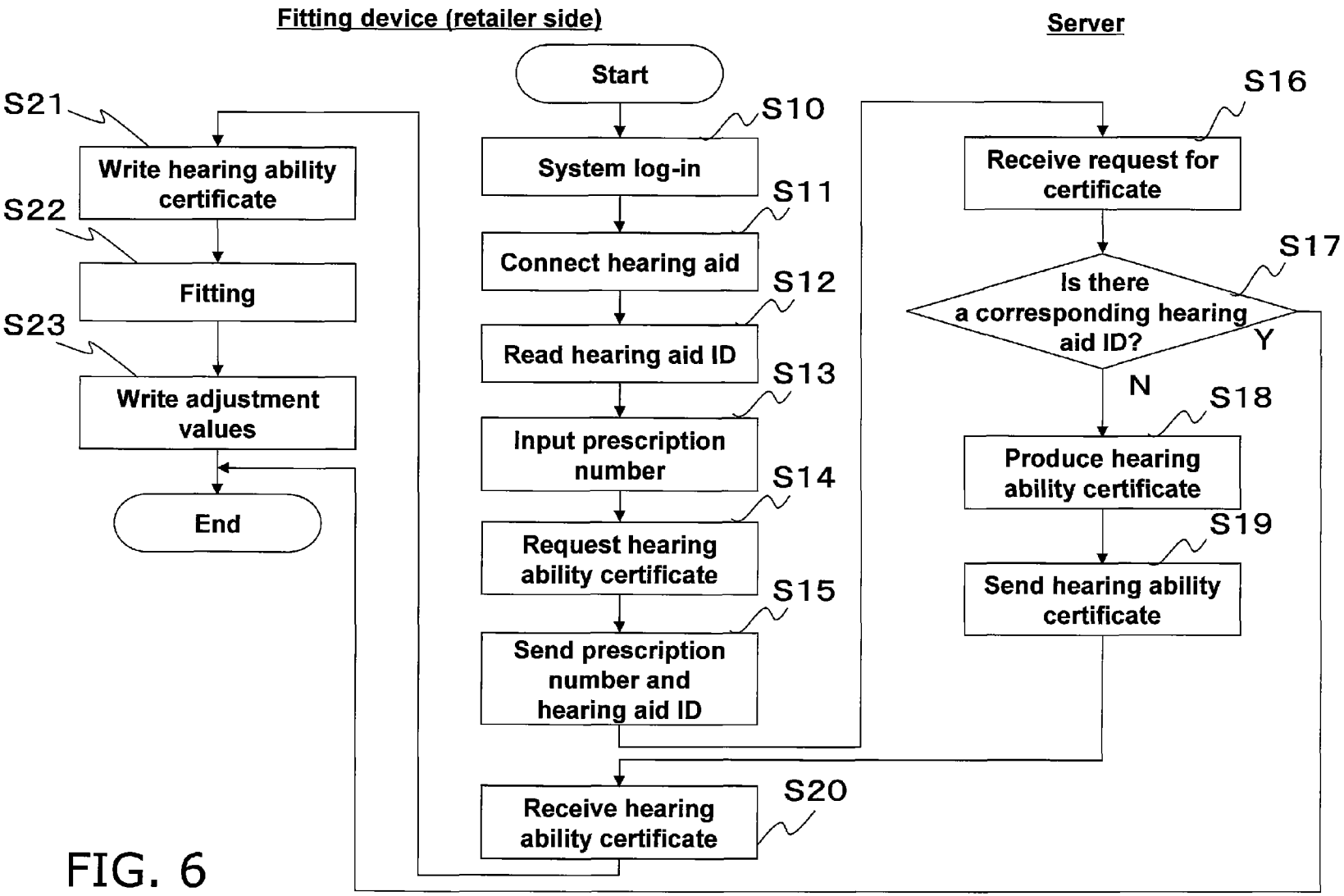
FIG. 6 is a flowchart of the operation between the fitting device and the server.

On the other hand, if an association has been set between the prescription number 7 and the hearing aid ID 13, then even if a hearing aid ID that is new with respect to that prescription number 7 is sent to the server 6, the processing will be ended by the determination in S17 of FIG. 6. Thus, that prescription number 7 cannot be used even when the patient 3 wishes to use another hearing aid. Therefore, "0000", for example, is assigned ahead of time as a deletion-use prescription number 7 in order to delete the association between the hearing aid ID 13 and the prescription number 7 that had been set. This deletion-use prescription number and the hearing aid ID 13 may be sent to the server 6 and the association between the hearing aid ID 13 and the prescription number 7 deleted. This makes it possible to store a new hearing aid ID in association with the prescription number 7, and obtain the corresponding hearing ability data. Thus, a hearing aid that is in the midst of fitting or actual use can be replaced with another hearing aid.

1-3-3. Operation of Hearing Aid

Figure 7:
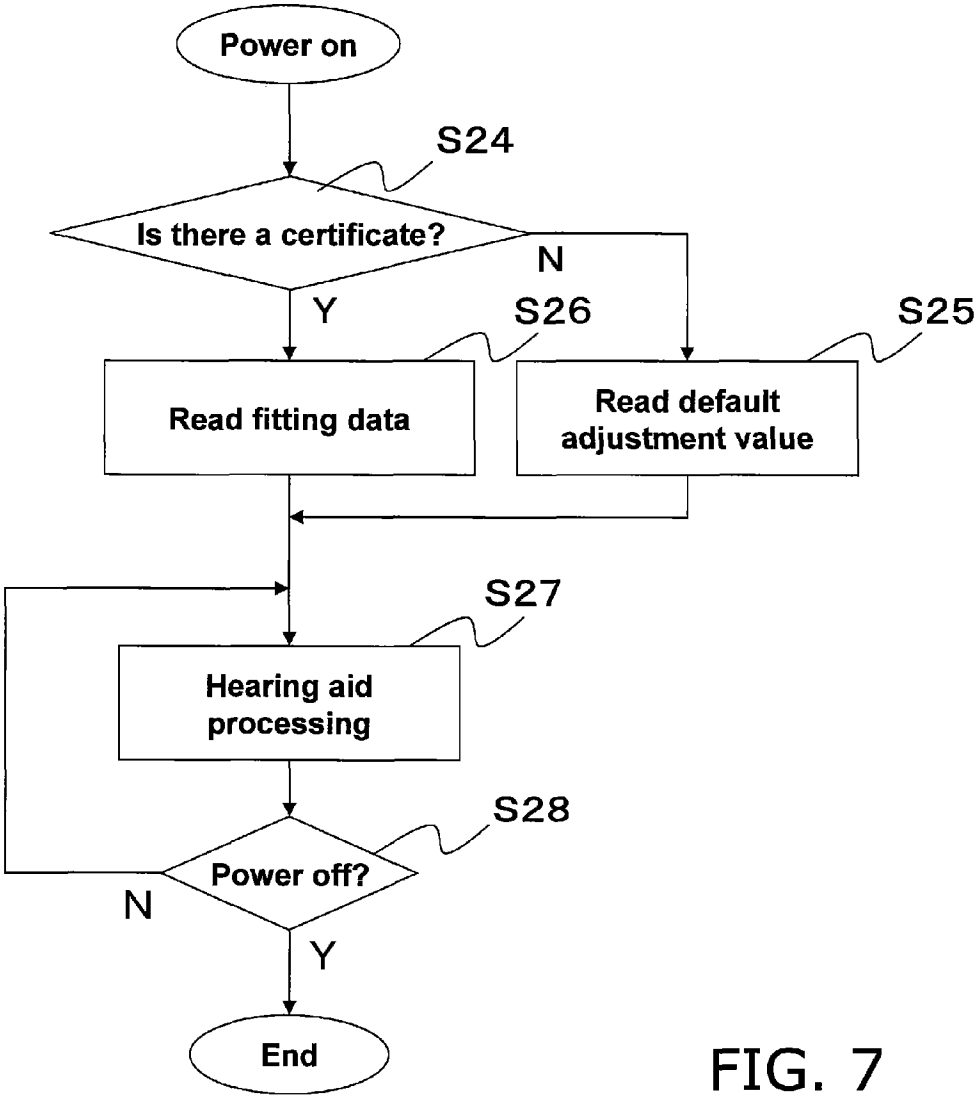
FIG. 7 is a flowchart of the operation of the hearing aid.

The operation of the hearing aid 9 main body will be described through reference to FIG. 7.

When the patient 3 switches on the power to the hearing aid 9, the controller 26 of the hearing aid 9 determines whether or not the hearing ability certificate 4A has been stored in the hearing ability certificate memory 28 (S24). If the controller 26 determines that the hearing ability certificate 4A has not been stored in the hearing ability certificate memory 28, then data stored in the default adjustment value memory 30 is read in the course of executing hearing aid processing by the hearing aid processor 33 (S25). If the controller 26 determines that a hearing ability certificate 4A has been stored in the hearing ability certificate memory 28, then data stored in the fitting data memory 29 is read in the course of executing hearing aid processing by the hearing aid processor 33 (S26).

After this, the hearing aid processor 33 performs hearing aid processing using the above-mentioned fitting data that was read (S27). The operation is ended when the patient 3 stops using the hearing aid 9 and turns off the power (S28).

The above-mentioned default adjustment value is a setting value for using the hearing aid 9 as a personal sound amplifier rather than a hearing aid. An example of the setting value of the default adjustment value is a value that allows general-purpose use for which the frequency band of approximately 500 Hz to 2 kHz is raised by approximately 30 dB, and other frequencies are lowered by approximately 15 dB.

If this is done, then even if the patient 3 purchases a hearing aid at the hearing aid retailer 8 prior to being diagnosed at the hospital 1, then the hearing aid can be used as a personal sound amplifier until the patient has time to be diagnosed by the physician 2 and the fitting work is completed at the hearing aid retailer 8.

1-4. Effects of the Embodiment

As discussed above, the hearing aid fitting management system pertaining to this embodiment comprises the fitting device 10 for making settings in the fitting of the hearing aid 9, the server 6 that is connected to the fitting device 10 so that data can be exchanged, and the client device 5 that is connected to the server 6 so that data can be exchanged. The client device 5 sends the server 6 hearing ability data 4 about the user of the hearing aid 9, and the server 6 stores hearing ability data 4 received from the fitting device 10 as the hearing ability certificate 4A, produces a prescription number 7 corresponding to the hearing ability certificate 4A, and sends the prescription number 7 to the client device 5. The fitting device 10 sends the inputted prescription number 7 to the server 6. The server 6 sends the fitting device 10 the hearing ability data 4 (the hearing ability certificate 4A) corresponding to the prescription number 7 received from the fitting device 10. The fitting device 10 sends the hearing ability certificate 4A to the hearing aid 9. The fitting device 10 limits the settings in the fitting of the hearing aid 9 to within the range of the hearing ability data 4.

Because of the above configuration, with the management system 100 according to this embodiment, even if the hearing aid 9 is fine-tuned by a person lacking knowledge of and experience in fitting, adjustment can be reliably carried out within the range of the proper hearing ability data measured by a physician or the like having specialized skills.

Also, the hearing aid 9 pertaining to this embodiment comprises the microphone 31, the hearing aid processor 33 that is connected to the microphone 31 and executes hearing aid processing, the receiver 35 that is connected to the hearing aid processor 33, and the controller 26 that is connected to the hearing aid processor 33. The controller 26 is connected to the hearing ability certificate memory 28 that holds the hearing ability data 4 (the hearing ability certificate 4A), the fitting data memory 29 that holds the fitting data set by fitting the hearing aid 9, and the default adjustment value memory 30 that holds default fitting data acquired before the fitting of the hearing aid 9. The controller 26 determines whether or not the hearing ability data 4 has been stored in the hearing ability certificate memory 28, and the hearing aid processor 33 executes hearing aid processing according to the result of this determination by the controller 26.

Because of the above configuration, the hearing aid 9 selects either fitting data or the default adjustment value and executes hearing aid processing on the basis of the determination of whether or not the hearing ability certificate 4A has been stored in the memory of the hearing aid 9. Therefore, the patient 3 can utilize the hearing aid 9 as a personal sound amplifier even before the hearing aid 9 is fitted by the physician 2.

2. Other Embodiments

In the above embodiment, a limitation was imposed so that fitting could not be performed if the UCL was exceeded, on the basis of the UCL of the hearing ability certificate 4A stored in the hearing ability certificate memory 23, but this is not the only option. Rather than using the UCL itself, it is also possible to clearly designate a volume upper limit and to limit fitting to within the range of this volume upper limit in order to ensure better safety. Another method that is similarly effective is to perform fitting by allowing a greater margin to the UCL and setting the upper limit at an output value that is 10 dB lower than the value of the UCL, for example. This reduces the burden on the ear that would be imposed by listening at a high volume for extended periods, and makes it possible to perform fitting with greater safety.

In the above embodiment, hearing ability data 4 was sent from the hospital 1 to the server 6, but it is also possible for fitting data produced by the physician 2 to be sent to the server 6, rather than just the hearing ability data 4. In this case, first the above-mentioned fitting data can be applied at the retailer 8, after which the fitting data can be updated by fine tuning. Here again, fine tuning can be performed at the retailer on the basis of limitation values based on the UCL stored in the hearing ability data 4.

In the above embodiment, the hearing ability data 4 was sent from the hospital 1 to the server 6, and the hearing ability certificate 4A was acquired from the server 6 at the retailer 8, but this is not the only option, as long as a physician or the like having specialized skill designates a proper fitting range. If the person at the retailer 8 is someone with qualifications, such as a speech-language-hearing therapist, then a configuration is also possible in which the hearing ability data 4 is produced and sent to the server 6 and a prescription is issued at the retailer 8, after which a hearing ability certificate is acquired along with this prescription and a hearing aid ID.

In the above embodiment, the hearing aid 9 was connected to the fitting device 10 via the connection box 11, but this is not the only option. The connection box 11 may be eliminated, and its functions (hearing aid writer and hearing aid reader) may be included in the hearing aid 9 or the fitting device 10, in which case the hearing aid 9 and the fitting device 10 may be directly connected.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents. Thus, the scope of the invention is not limited to the disclosed embodiments.

REFERENCE SIGNS LIST

1 hospital
2 physician
3 patient
4 hearing ability data
5 client device
6 server
7 prescription number
8 hearing aid retailer
9 hearing aid
10 fitting device
11 connection box
12 adjuster
13 hearing aid ID
14 input component
15 display component
16 controller
17 controller
18 memory device
19 controller
20 input component
21 display component
22 fitting data memory
23 hearing ability certificate memory
24 hearing aid writer
25 hearing aid reader
26 controller
27 hearing aid ID memory
28 hearing ability certificate memory
29 fitting data memory
30 default adjustment value memory
31 microphone
32 A/D converter
33 hearing aid processor
34 D/A converter
35 receiver

What is claimed is:

1. A hearing aid fitting management system, comprising:

a first client device that makes fitting settings to a hearing aid;

a server device operationally connected to the first client device so as to be capable of sending and receiving data to and from the first client device; and a second client device operationally connected to the server device so as to be capable of sending and receiving data to and from the server device, wherein the second client device sends the server device hearing ability data about a user of the hearing aid, the server device stores the hearing ability data received from the second client device, produces prescription number data corresponding to the hearing ability data, and sends the prescription number data to the second client device, the first client device receives the prescription number data as an input, and sends the server device the prescription number data that has been inputted, the server device sends the first client device the hearing ability data corresponding to the prescription number data received from the first client device, and the first client device limits the fitting settings of the hearing aid to within a range based on the hearing ability data.

2. The hearing aid fitting management system according to claim 1, wherein the first client device sends the server device first hearing aid ID data for identifying the hearing aid along with the prescription number data, in order to acquire the hearing ability data stored in the server device, the server device stores the prescription number data such that the prescription number data is associated with the first hearing aid ID data, and when the server device has received the prescription number data again along with second hearing aid ID data and has determined that the stored first hearing aid ID data differs from the second hearing aid ID data, the server device prohibits transmission of the hearing ability data corresponding to the prescription number data.

3. The hearing aid fitting management system according to claim 2, wherein when the first client device has sent the server device the first hearing aid ID data and specific prescription number data that is different from any prescription number data stored in the server device, the server device eliminates the stored association of the first hearing aid ID with the prescription number data and becomes capable of transmitting the hearing ability data corresponding to the prescription number data by allowing association of the prescription number data with any hearing aid ID data that the server receives.

4. The hearing aid fitting management system according to claim 1, wherein the hearing ability data includes at least data expressing a discomfort level.

5. The hearing aid fitting management system according to claim 4, wherein the first client device limits the fitting settings of the hearing aid such that the discomfort level is not exceeded.

6. A computer device that is connectable to a hearing aid and makes fitting settings to hearing aid, said computer device comprising:

an input component that receives an input of data;

a memory that stores data; and a controller that is operationally connected to the input component and the memory and that:

processes, transmits, and receives data, sends prescription number data that has been inputted through the input component, to a server device operationally connected to the computer device, the prescription number data specifying hearing ability data about a user of the hearing aid, receives the hearing ability data corresponding to the prescription number data from the server device and stores the hearing ability data in the memory, limits the fitting settings of the hearing aid to within a range based on the hearing ability data, and produces fitting data based on the fitting settings of the hearing aid, and sends the fitting data to the hearing aid.

7. The computer device according to claim 6, wherein the hearing ability data is at least data expressing a discomfort level.

8. The computer device according to claim 7, wherein the controller limits the fitting settings of the hearing aid such that the discomfort level is not exceeded.

9. A server device connectable to a first client device that makes fitting settings to a hearing aid, and to a second client device that produces hearing ability data for a user of the hearing aid, and that manages data for the fitting of the hearing aid, said server device comprising:

a memory; and a controller that:

stores the hearing ability data received from the second client device in the memory, produces prescription number data corresponding to the hearing ability data and sends the prescription number data to the second client device, and when having received the prescription number data from the first client device, sends the first client device the hearing ability data corresponding to the received prescription number data wherein the hearing ability data is data based on which a range of the fitting settings of the hearing aid is to be limited by the first client device.

10. The server device according to claim 9, wherein when the controller has received first hearing aid ID data for identifying the hearing aid along with the prescription number data from the first client device, the controller determines whether or not any hearing aid ID data associated with the received prescription number data is stored in the memory, and when the controller has determined that any hearing aid ID data associated with the received prescription number data is not stored in the memory, the controller stores the received prescription number data such that the received prescription number data is associated with the received first hearing aid ID.

11. The server device according to claim 9, wherein, when the controller has received second hearing aid ID data along with the prescription number data, the controller determines whether or not first hearing aid ID data stored in the memory and associated with the received prescription number data matches the second hearing aid ID data, and when the controller has determined that there is no match, the controller prohibits transmission of the hearing ability data corresponding to the prescription number data.

12. The server device according to claim 11, wherein when the controller has received the first hearing aid ID data and specific prescription number data that is different from any prescription number data stored in the memory, the controller eliminates the association of the first hearing aid ID with the prescription number data stored in the memory.

13. A hearing aid fitting management system, comprising:

the server device according to claim 9; and a computer device that is connectable to the server device and to a hearing aid, operates as the first client device, and makes fitting settings to the hearing aid, said computer device comprising:

an input component that receives an input of data;

a computer-device-memory that stores data; and a computer-device-controller that is operationally connected to the input component and the computer-device-memory and that;

processes, transmits, and receives data, sends prescription number data that has been inputted through the input component, to the server device operationally connected to the computer device, the prescription number data specifying hearing ability data about a user of the hearing aid, receives the hearing ability data corresponding to the prescription number data from the server device and stores the hearing ability data in the computer-device-memory, limits the fitting settings of the hearing aid to within a range based on the hearing ability data, and produces fitting data based on the fitting settings of the hearing aid, and sends the fitting data to the hearing aid.

14. The hearing aid fitting management system according to claim 13, further comprising a second client device that is operationally connected to the server device and has a second-client-device-controller that produces the hearing ability data and sends the hearing ability data to the server device.

* * * * *